US005802669A

United States Patent [19]

Wurdack

[11] Patent Number: 5,802,669

[45] Date of Patent: Sep. 8, 1998

[54] MOLDED SLIDE

[75] Inventor: Roy A. Wurdack, Warrenton, Mo.

[73] Assignee: Renovisions, Inc., Wilmington, Del.

[21] Appl. No.: 562,822

[22] Filed: Nov. 27, 1995

Related U.S. Application Data

[63] Continuation-in-part of Ser. No. 143,836, Oct. 27, 1993, Pat. No. 5,469,599.

[51] Int. Cl.[6] ..... A47B 91/06

[52] U.S. Cl. ..... 16/42 R

[58] Field of Search ..... 16/42 T, 42 R

[56] References Cited

U.S. PATENT DOCUMENTS

| | | | |
|---|---|---|---|
| 2,827,655 | 3/1958 | Ustica | 16/42 |
| 3,177,518 | 4/1965 | Bergstrom | 16/42 R |
| 3,183,545 | 5/1965 | Bergstrom | 16/42 R |
| 3,326,508 | 6/1967 | Born | 248/346.1 |
| 3,623,184 | 11/1971 | Mazur | 16/42 R |
| 3,847,452 | 11/1974 | Harder | 308/6 R |
| 3,883,923 | 5/1975 | England | 16/42 R |
| 4,696,582 | 9/1987 | Kasten | 384/18 |
| 4,984,332 | 1/1991 | Bienert et al. | 16/93 R |
| 5,081,740 | 1/1992 | Smith | 16/42 R |
| 5,220,705 | 6/1993 | Bushey | 16/42 R |
| 5,426,818 | 6/1995 | Bushey | 16/42 R |
| 5,469,599 | 11/1995 | Wurdack | 16/42 R |
| 5,557,824 | 9/1996 | Bushey | 16/42 R |

OTHER PUBLICATIONS

Beno J. Gundlach Company Catalog 120, Copyright ©1990, p. 5, item No. 933 Easy Skids.

"TIVAR Means Abrasion Resistance".

*Primary Examiner*—A. L. Pitts
*Assistant Examiner*—Donald M. Gurley
*Attorney, Agent, or Firm*—Kilpatrick Stockton LLP; John S. Pratt; Michael F. Labbee

[57] ABSTRACT

A slide to be partially inserted under a floor contact portion of a heavy structure such that the structure can be easily slid a short distance. The slide is formed as a laminar assembly including a flat plate formed of an abrasion resistant lubric plastic material made of polyoxymethylene, homopolymer acetal, and a non-slip pad made of a synthetic plastic material. That portion of the plate not under the floor contact portion tends to bend upwardly so that the heavy structure slides easily over the floor while the pad keeps the heavy structure from sliding off the slide.

9 Claims, 3 Drawing Sheets

MOLDED SLIDE

This application is a continuation-in-part of Ser. No. 08/143,836, filed Oct. 27, 1993, for Slide now U.S. Pat. No. 5,469,599.

BACKGROUND OF THE INVENTION

1. Field of the Invention

The present invention relates to a molded slide for moving heavy office files, furniture and equipment, for example, during the installation of modular carpet or during office reconfiguration.

2. Brief Description of the Prior Art

Modular carpet is designed to be installed in occupied office areas with furniture and equipment in place. During installation, furniture and equipment is moved a short distance or lifted while the old flooring is removed and squares of new modular carpet installed. The office furniture and equipment is then slid or lowered into place, permitting installation of a new carpet without breaking down work stations, disrupting telecommunication or computer hook-ups and avoiding business interruption.

Office downsizing, team spaces, wiring upgrades, etc., frequently mandate office reconfigurations requiring that the furniture be moved or rotated. Furniture is also frequently moved, for example, in healthcare and educational facilities for cleaning. In these instances, as in the installation of modular carpet, it is desirable to move the furniture quickly, with the least possible effort and, preferably, after hours with a limited number of workers.

A filing cabinet, particularly lateral or fire resistant filing cabinets, for example, are too heavy for a man to lift and very difficult to slide, with some cabinets weighing 2,000 pounds or more. Such office equipment is usually moved with a hand truck, four wheel dolly or the like and takes a crew of men. The work is hard, labor expensive and injuries occur. Other furniture, such as work stations, computers, etc. are also difficult to move.

In U.S. application Ser. No. 08/143,836, Wurdack identified ultra high molecular weight polyethylene as being particularly suitable for use as a slide for moving heavy furniture when provided as a flat plate having a thickness between about 0.05 inch to about 0.15 inch and having a diameter between about 4 inches and about 10 inches. The disks were cut from sheets of ultra high molecular weight (UHMW) polyethylene which are formed industrially by skiving large blocks of UHMW polyethylene. A non-slip pad of synthetic plastic material was then glued to the top surface of the disk.

A more aesthetically pleasing disk would have a recess formed in its upper surface for receipt of a non-slip pad upon which could be printed a message or the like as an advertising medium. It is cost prohibitive, however, to machine a recess into a disk made of UHMW polyethylene and UHMW polyethylene cannot be molded into disks. Therefore, Wurdack began a search for another plastic material, having the load bearing capability and friction resistance of UHMW polyethylene but which is moldable.

The suitability of a plastic material for a given application depends, not on a single property, but on a combination of properties. While data on plastic materials is useful for comparing and selecting candidate materials, final choice is made by end-use testing. Based on data sheets provided by various vendors, nylon, Teflon and high density polyethylene (which differs from UHMW polyethylene), all looked like good candidates, but failed in the field. Other materials were eliminated based on the data sheets. For example, disks molded from high density polyethylene shrank so that a five-inch disk was cupped as much as 0.5 inch off the floor, making it difficult to slip under a piece of furniture. In addition, the disks formed from high density polyethylene tended to melt under heavy load. Nylon disks could be formed but did not slide well over carpets and Teflon could not be injection molded.

SUMMARY OF THE INVENTION

In view of the above, it is an object of the present invention to provide a slide, made of a moldable plastic, with a recess within which a non-slip pad can be fitted, that can be used as a "flat dolly" under the corners of a filing cabinet (or other piece of furniture or equipment), such that the piece can be easily slid a short distance. It is another object to provide such a slide which can be used to facilitate movement of office furniture and equipment in the installation of modular carpet and which can be used as an advertising specialty by imprinting an advertising message on the non-slip pad. Other objects and features of the invention will be in part apparent and in part pointed out hereinafter.

In accordance with the invention, a slide for use in moving a heavy structure includes a flexible plate and a non-slip pad. The plate is formed of polyoxymethylene, homopolymer acetal, having a coefficient of friction of about 0.3 and a pressure versus velocity of about 750 or better. The non-slip pad is formed of synthetic plastic material. The plate is about 0.05 inch to about 0.15 inch thick and has a diameter between about 4 inches and about 10 inches. The plate has an upper face and a lower face joined by a rim with the pad adhesively fixed to and generally covering the upper face of the plate, preferably within a recess provided in the upper face of the plate for that purpose. The lower face is curved slightly upwardly so that the rim is elevated above a plane surface upon which the slide is placed by no more than about ⅛ inch.

The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention are illustrated, corresponding reference characters refer to corresponding parts throughout the several views of the drawings in which.

DETAILED DESCRIPTION OF THE INVENTION

Figure 1:
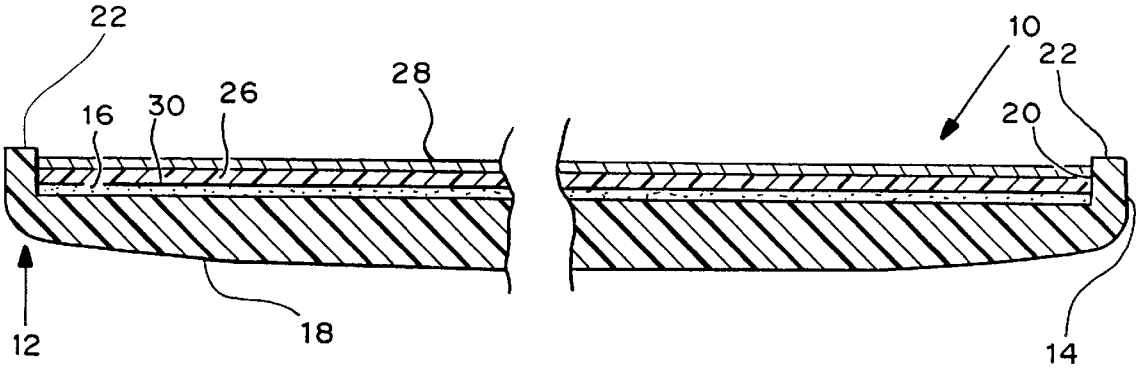
FIG. 1 is an enlarged sectional view of a slide in accordance with the present invention.

Referring to the drawings more particularly by reference character, reference numeral 10 refers to a slide for moving heavy office files, furniture, equipment and the like. Slide 10 is formed as a laminar assembly including a plate 12 with a rim 14 and upper and lower faces 16, 18, respectively. Lower face 18 is curved slightly upwardly such that rim 14 is elevated above a plane upon which slide 10 is placed by no more than about ⅛ inch and preferably by no more than about 1/16 inch such that the slide can be easily slipped under the object to be moved. A recess 20 is formed in upper face 16 surrounded by a lip 22 that extends to rim 14.

Plate 12 is molded from an abrasion resistant lubric plastic material. Suitable material identified for this purpose are the polyoxymethylenes, homopolymer acetals, having a coefficient of friction as measured by ASTM D3702 of about 0.3 and a PV (pressure versus velocity) value of about 750 or better. Suitable commercially available polyoxymethylenes are made from formaldehyde and are sold by DuPont Engineering Polymers of Wilmington, Delaware under the trademark DELRIN 500. Tougheners, such as elastomer-like polymers, can be added to the polyoxymethylenes, a preferred one of which, is sold by DuPont under the trademark DELRIN 500T. For use in the present invention, the coefficient of friction is critical as it is related to how easily slide 10 can be moved along a floor. The PV value is also critical as it is related to how well slide 10 performs under severe conditions of weight and movement. As plate 12 is slid across the floor, with four slides bearing a load of 2,000 pounds, for example, slide 10 must not heat up enough that the material undergoes a transition phase manifested, for example, as cracks, bubbles, etc. Slides made from DELRIN 500 and DELRIN 500T meet these performance requirements.

Plate 12 is no thinner than 0.05 inch and less than 0.15 inch thick and is preferably between about 0.05 (1/16) inch and about 0.09 (93/1000) inch, most preferably about 0.07 (74/1000) inch. Thicker plates do not flex enough to allow rim 14 to ride over depressions and bumps in the carpet, whereas thinner plates flex too much. Thinner plates 12 (e.g., 0.05 inch) are preferred for use on glued down or modular carpet and thicker plates (e.g., approaching 0.15 inch) are preferred when slide 10 is used on a masonry or tile floor or on plush carpeting.

Rim 14 is preferably continuously convex, which with the slight curvature of lower face 18, keep slide 10 from plowing into a carpet 24 or the like. The flexibility of the slide is a function of the width and thickness of plate 12 for a given material. Bounded by these requirements, plate 12 is preferably generally circular in plan and has a diameter from about 4 inches to about 10 inches with a diameter of about 6 inches being preferred for most applications. If the plate is under 3 inches in diameter it is too small for use in moving heavy furniture, whereas diameters greater than 12 inches should be avoided because the slides generate too much friction with the floor. When slide 10 is molded in a flat mold from DELRIN 500 or DELRIN 500T and has a diameter between about 4 and 6 inches, plate 12 takes on the required curvature and has proper flexibility.

Pad 26 is made from a layer of tough synthetic plastic material. To facilitate insertion of slide 10 under heavy structures, it is important that slide 10 be as thin as possible, hence the thickness of pad 26 should be minimized, consistent with providing a pad that does not tear in use. Suitable materials include foamed ethylvinylacetate (EVA). Recess 20 is preferably about ⅛ inch deep and pad 26 is preferably about ⅛ inch thick such that it is recessed entirely within or extends only slightly above lip 22. In other cases, which may depend on the compressibility of pad 26, recess 20 may be slightly deeper than pad 26 is thick so that lip 22 forms a bumper stopping the furniture from sliding off slide 10.

It is preferred that pad 26 be covered with a tear resistant fabric 28 made of polyester or the like. It is also preferred that pad 26, when made of EVA, be glued in recess 20 with an adhesive 30 such as acrylic latex that remains tacky so as to act as a pressure sensitive adhesive. When pad 26 is covered with fabric 28, it can be printed with an advertising message. The polyoxymethylene used for molding plate 12 can be colored so that the plate can be color coordinated with the fabric selected to cover pad 26. Because slides 10 work so well for their intended purpose and are so useful, they make a welcome business gift and are an effective medium for advertising.

Figure 3:
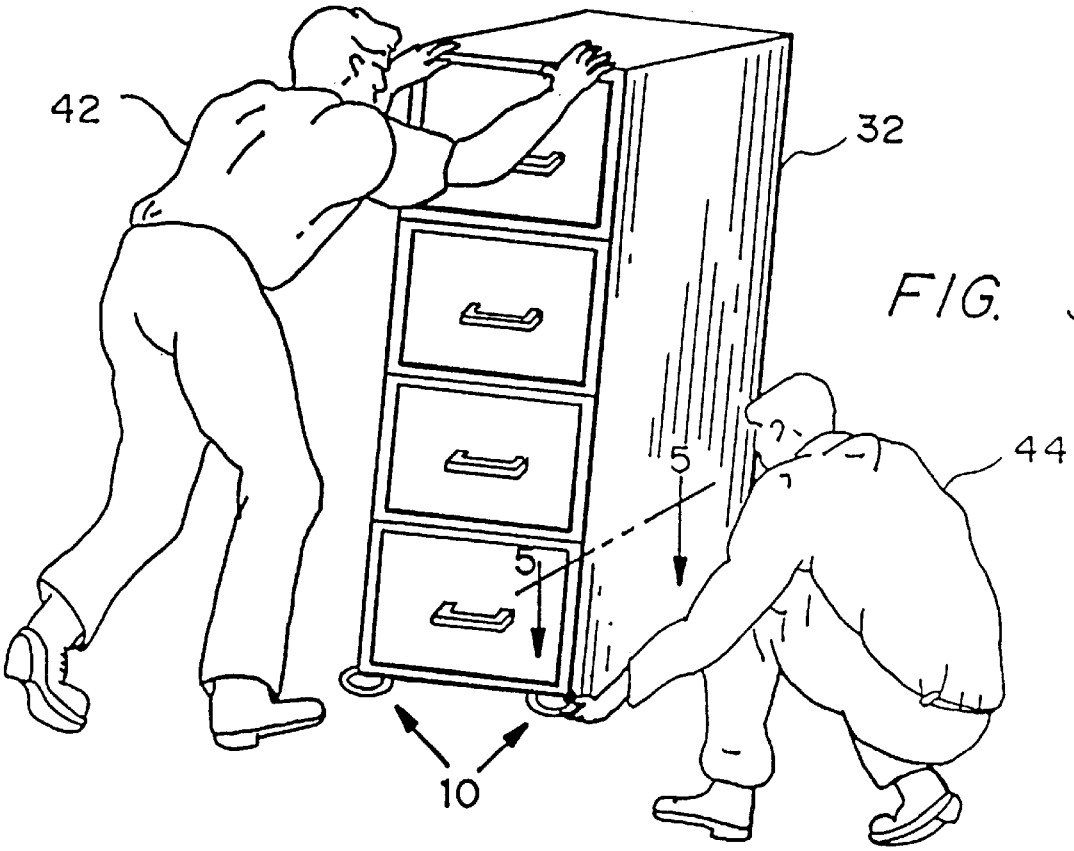
FIG. 3 is a perspective view of a pair of slides being inserted beneath a floor contact portion of a heavy structure such as a filing cabinet.
Figure 2:
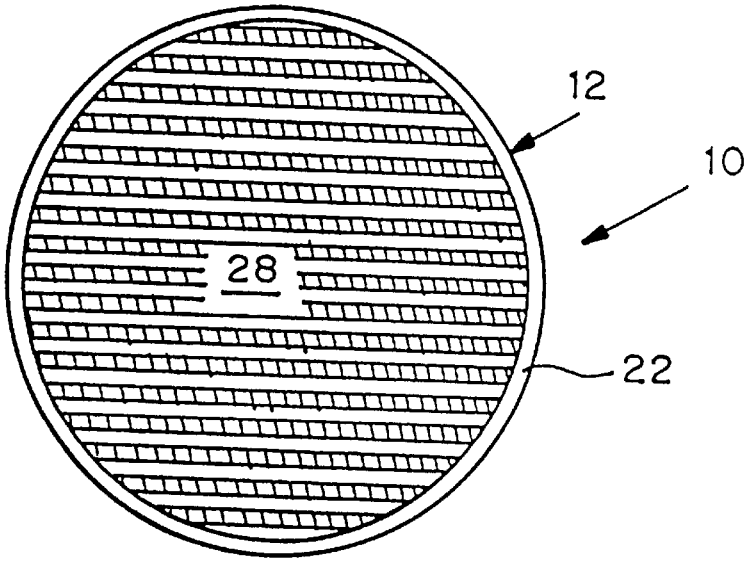
FIG. 2 is a plan view, on a reduced scale, of the slide.
Figure 4:
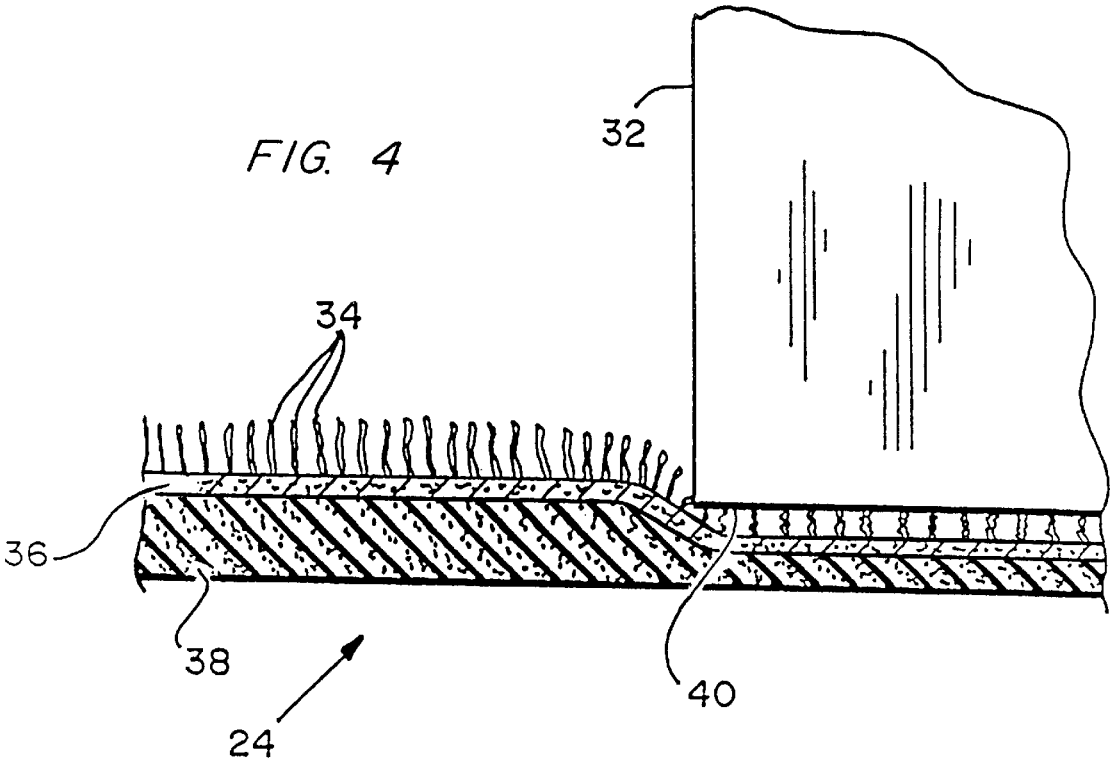
FIG. 4 is a sectional view of the heavy structure sitting on a carpet, prior to being moved; and, FIG. 5 is a sectional view taken along line 5—5 in FIG. 3 showing the slide under the floor contact portion of the heavy structure in the process of being slid across a floor.
Figure 5:
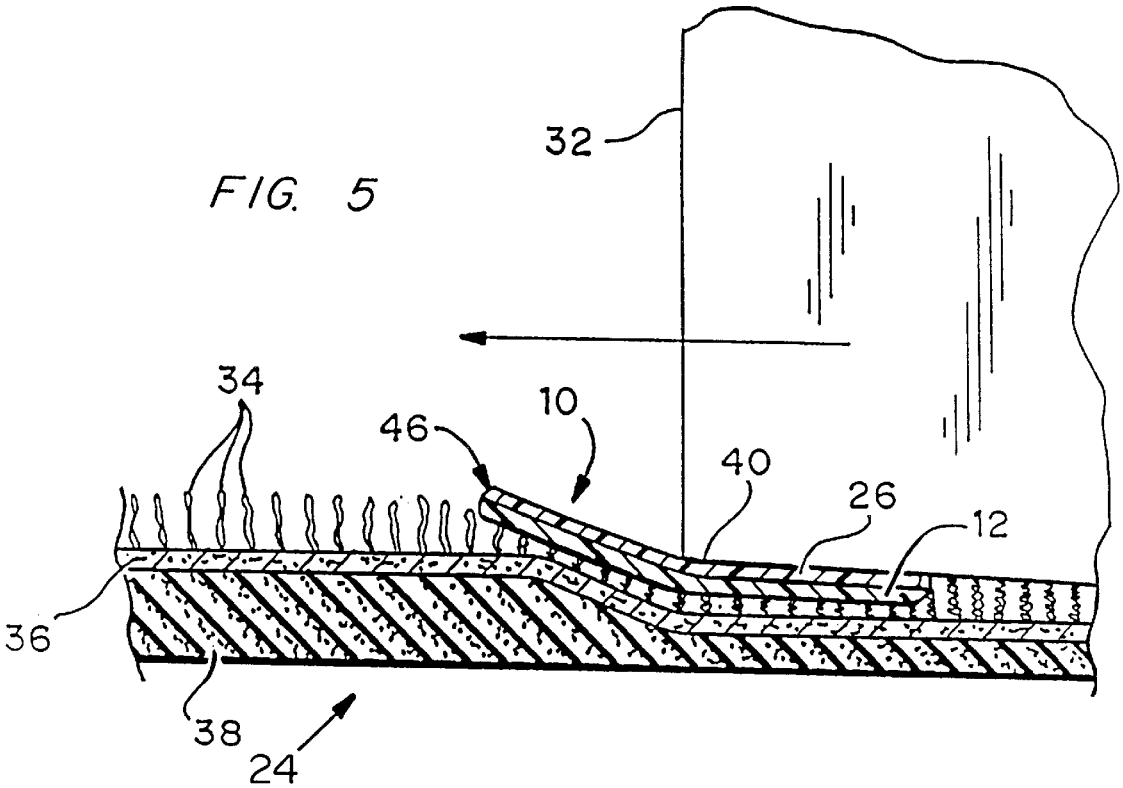

A filing cabinet 32 is shown in FIG. 4 sitting on a carpet 24 which includes a fiber piling 34 attached to a backing 36 over a sponge rubber pad 38. Cabinet 32 is indented into the carpet. In use as shown in FIGS. 3 and 5, slide 10 is inserted beneath a floor contact portion 40 of a heavy structure such as filing cabinet 32 or the like. To accomplish this operation, a first worker 42 pivots cabinet 32 about its rear edge by pushing on the cabinet along a top edge and, while cabinet 32 is reared up, a second worker 44 slips one of slides 10 partially under floor contact portion 40 at each of the front corners. Alternatively, first worker 42 may simply push slides 10 under the cabinet with his foot.

With continuing reference to FIGS. 3 and 5, it is seen that about ¼ to ½ of slide 10 is not under cabinet 32, forming a free portion 46 that flexes upwardly in inclined relationship under the upward force of carpet 24. With slides 10 under the front corners, cabinet 32 can be easily slid away from a wall against which it is standing. As cabinet 32 slides in the direction of the arrow in FIG. 5, free inclined portion 46 helps the cabinet to slide out of the indent into which the cabinet naturally settles. A second set of slides can then be inserted under the rear corners, if desired.

Because of the heavy weight of the structure being moved, lower face 18 of plate 12 is put under severe conditions of weight and movement and will heat up and break down if not formed of the right material. When slide 10 is formed as described above, it has the desired combination of characteristics, yet is moldable. Slides 10 can be used as an advertising specialty, if desired.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A temporary slide to be partially inserted beneath a floor contact portion of a heavy structure to enable easy sliding, said slide comprising a flexible plate formed of polyoxymethylene homopolymer acetal, having a coefficient of friction of about 0.3 and a pressure versus velocity of about 750 or better and a non-slip pad formed of synthetic plastic material, said plate being no thinner than about 0.05 inch, having a diameter between about 4 inches and about 10 inches, and having an upper face and a lower face joined by a peripheral upstanding rim, said pad adhesively fixed to and extending over the upper face to the rim whereby that part of the plate not under the floor contact portion tends to bend upwardly to slide easily over the floor while the pad keeps the heavy structure from sliding off the slide.

2. The slide of claim 1 wherein a recess is formed in the upper face into which is received the pad.

3. The slide of claim 2 wherein the lower face has a slight upward curvature and the rim is elevated above a plane surface upon which the slide is placed by no more than about ⅛ inch.

4. The slide of claim 3 wherein the rim is elevated by no more than about 1/16 inch.

5. The slide of claim 2 wherein the pad is formed of foamed ethylvinylacetate and glued into the recess with an acrylic latex.

6. The slide of claim 5 wherein the pad is covered with a tear-resistant fabric.

7. The slide of claim 6 wherein the fabric is polyester.

8. A slide for temporary use in moving heavy furniture comprising:

a) a flexible plate made of polyoxymethylene homopolymer acetal having a coefficient of friction of about 0.3 and a pressure versus velocity of about 750 or better, the plate having a top surface and a bottom surface in which the top surface defines a recessed area and a peripheral lip having a predetermined height above the recessed area; and b) a non-slip pad affixed to the top surface of the flexible plate within the recessed area and extending to the lip thereby forming a generally continuous upper surface.

9. A slide for temporary use in moving heavy furniture comprising:

a) a flexible plate made of polyoxymethylene homopolymer acetal having a coefficient of friction of about 0.3 and a pressure versus velocity of about 750 or better, the plate having a top surface and a bottom surface in which the top surface defines a recessed area and a peripheral lip having a predetermined height above the recessed area; and b) a non-slip pad affixed to the top surface of the flexible plate within the recessed area and extending to the lip thereby forming a generally continuous upper surface, in which the overall thickness of the pad is less than the height of the lip.

* * * * *